US012404092B1

(12) United States Patent
Marshalleck

(10) Patent No.: US 12,404,092 B1
(45) Date of Patent: Sep. 2, 2025

(54) PRESSURE REGULATED VOLUME EXCHANGE CONTAINER

(71) Applicant: Iron Giant Tech LLC, New York, NY (US)

(72) Inventor: David Marshalleck, New York, NY (US)

(73) Assignee: Iron Giant Tech LLC, New York, NY (US)

( * ) Notice: Subject to any disclaimer, the term of this patent is extended or adjusted under 35 U.S.C. 154(b) by 0 days.

(21) Appl. No.: 18/985,380

(22) Filed: Dec. 18, 2024

(51) Int. Cl.
*B65D 88/74* (2006.01)
*B65D 88/00* (2006.01)
*B65D 90/32* (2006.01)

(52) U.S. Cl.
CPC ..... *B65D 88/748* (2013.01); *B65D 88/005* (2013.01); *B65D 90/32* (2013.01)

(58) Field of Classification Search
CPC .... B65D 88/748; B65D 88/005; B65D 90/32; B65D 5/48; B65D 7/065; B65D 25/04; B65D 85/8049; B65D 85/8052; B65D 83/0829; B65D 90/51
See application file for complete search history.

(56) References Cited

U.S. PATENT DOCUMENTS 720,902 A * 2/1903 Brau ..... B65D 83/62 119/65
2,758,747 A 8/1956 Stevens
3,172,556 A 3/1965 Gottfried
3,931,907 A 1/1976 Henle
4,077,544 A * 3/1978 Malacheski ..... A47L 1/02 222/105
4,228,754 A 10/1980 Shibata et al.
4,325,823 A * 4/1982 Graham ..... C02F 3/1252 210/207
5,199,594 A 4/1993 Obara et al.
5,462,201 A * 10/1995 Wilkins ..... B65D 83/766 222/472
6,070,477 A 6/2000 Mark
6,280,614 B1 * 8/2001 Berg ..... B01D 21/0012 210/232
6,811,056 B2 11/2004 Gabes
(Continued)

FOREIGN PATENT DOCUMENTS

FR 2564439 A1 11/1985
WO 2005095155 A1 10/2005

*Primary Examiner* — Kareen K Thomas
(74) *Attorney, Agent, or Firm* — Mark Terry

(57) ABSTRACT

A pressure regulated volume exchange container includes a container body for holding both a first fluid and a second fluid, the container body defining a first volume portion and a second volume portion, a movable barrier disposed within the container body, the barrier configured to adjust the size of the first and second volume portions, an outlet in the container body through which the first fluid is extracted from the first volume portion, an inlet in the container body through which the second fluid is introduced into the second volume portion, and, an actuator mechanism operably connected to the movable barrier, the mechanism for moving the barrier within the container body in response to extraction of fluid from, or introduction of fluid to, the container body, wherein said actuator mechanism moves said movable barrier so as to maintain a predefined pressure within the first volume portion.

18 Claims, 5 Drawing Sheets

(56) References Cited

U.S. PATENT DOCUMENTS

| | | | | |
|---|---|---|---|---|
| 10,569,929 | B2 * | 2/2020 | Colla | B65D 75/38 |
| 10,596,069 | B2 * | 3/2020 | Goodman | A61M 5/3145 |
| 11,691,808 | B2 | 7/2023 | Kotora | |
| 11,993,455 | B2 * | 5/2024 | Lambert | B01F 23/50 |
| 2003/0118145 | A1 | 6/2003 | Faris | |
| 2006/0096990 | A1 | 5/2006 | Reed | |
| 2012/0091135 | A1 * | 4/2012 | Ben Afeef | F16J 15/106 220/220 |
| 2016/0130078 | A1 | 5/2016 | Galvin | |

* cited by examiner

PRESSURE REGULATED VOLUME EXCHANGE CONTAINER

CROSS REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to fluid transport, storage and transfer systems, and more particularly to containers designed for the transportation and the controlled exchange of fluids within a single, enclosed volume.

BACKGROUND

In various fields, fluid storage and transfer systems are commonly used to access, dispense, and manage liquids for specific applications, such as consumption, washing, cleaning, or fluid conservation efforts. A typical setup in these applications involves two separate containers or reservoirs: one that supplies a clean or unused fluid and another that captures or stores the resulting runoff. This arrangement can be cumbersome, as it requires multiple storage units, additional equipment for transfer, and often manual intervention to facilitate the movement of fluids between reservoirs. These conventional systems are generally inefficient and take up significant space, making them impractical for applications where compact, integrated solutions are necessary.

The need for a streamlined, single-unit solution that allows fluid to be accessed and stored in a controlled manner has become more pressing as fluid conservation and recycling become prioritized across industries. Traditional solutions lack the flexibility to adapt to varying fluid volumes without requiring complex and costly modifications. Furthermore, conventional designs are often prone to cross-contamination between clean and runoff fluids due to inadequate separation within the system, thereby reducing the quality or usability of the stored fluids.

In addition, current systems typically do not include mechanisms to control fluid volume effectively or dynamically within a single container, resulting in inefficient use of available space. They also require frequent handling and oversight, making them less desirable for continuous or automated operations. Consequently, there is an ongoing demand for a more versatile and compact fluid management system that can manage both clean fluid dispensing and runoff collection within a single structure while maintaining reliable separation and ease of use.

Prior art systems for fluid management also often suffer from an absence of effective internal pressure control, which limits their ability to efficiently transfer and separate fluids within a container. In traditional designs, the lack of pressure mechanisms results in passive or gravity-reliant fluid movement, which is not only slow but also prone to uneven flow and inconsistent separation between unused and used fluids. Without the application of controlled pressure, these systems struggle to maintain fluid levels that adapt in real-time to changes in volume, often leading to spillage, cross-contamination, and inefficient fluid utilization. The absence of a pressure-regulated barrier or actuator within the system means that users must rely on external equipment or manual intervention to facilitate fluid transfer, increasing operational complexity and reducing overall efficiency. This lack of pressure management limits the applicability of these systems in environments that require precision and a high degree of control over fluid exchange processes.

Therefore, a need exists to overcome the problems with the prior art as discussed above, and particularly for a more efficient and economical method and apparatus that allows for fluid storage and transfer for both a clean or unused fluid, as well as the resulting runoff.

SUMMARY

A pressure regulated volume exchange container is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a pressure regulated volume exchange container is provided that solves the above-described problems. The pressure regulated volume exchange container includes a container body configured to hold both a first fluid and a second fluid, the container body defining a first volume portion and a second volume portion, a movable barrier disposed within the container body, the barrier configured to adjust the size of the first and second volume portions, an outlet in the container body through which the first fluid is extracted from the first volume portion, an inlet in the container body through which the second fluid is introduced into the second volume portion, and, an actuator mechanism operably connected to the movable barrier, configured to move the barrier within the container body in response to extraction of fluid from, or introduction of fluid to, the container body, wherein said actuator mechanism moves said movable barrier so as to maintain a predefined pressure within the first volume portion.

In another embodiment, the pressure regulated volume exchange container includes a container body configured to hold both a first fluid and a second fluid, the container body defining a first volume portion and a second volume portion, a movable barrier disposed within the container body, the barrier configured to adjust the size of the first and second volume portions, an outlet in the container body through which the first fluid is extracted from the first volume portion, an inlet in the container body through which the second fluid is introduced into the second volume portion, a first pressure sensor in the first volume portion, an actuator mechanism operably connected to the movable barrier, configured to move the barrier within the container body when activated, and, a computing device communicatively coupled to the first pressure sensor and the actuator mechanism, the computing device configured to: 1) read pressure data from the first pressure sensor, 2) calculate a desired position of the movable barrier within the container body so as to achieve a first predefined pressure within the first volume portion, and 3) activate the actuator mechanism to move the movable barrier to the desired position.

Additional aspects of the claimed subject matter will be set forth in part in the description which follows, and in part will be obvious from the description, or may be learned by practice of the claimed subject matter. The aspects of the claimed subject matter will be realized and attained by means of the elements and combinations particularly pointed out in the appended claims. It is to be understood that both the foregoing general description and the following detailed description are exemplary and explanatory only and are not restrictive of the disclosed subject matter, as claimed.

BRIEF DESCRIPTION OF THE DRAWINGS

The accompanying drawings, which are incorporated in and constitute part of this specification, illustrate embodiments of the claimed subject matter and together with the description, serve to explain the principles of the claimed subject matter. The embodiments illustrated herein are presently preferred, it being understood, however, that the claimed subject matter is not limited to the precise arrangements and instrumentalities shown, wherein:

DETAILED DESCRIPTION

Figure 1:
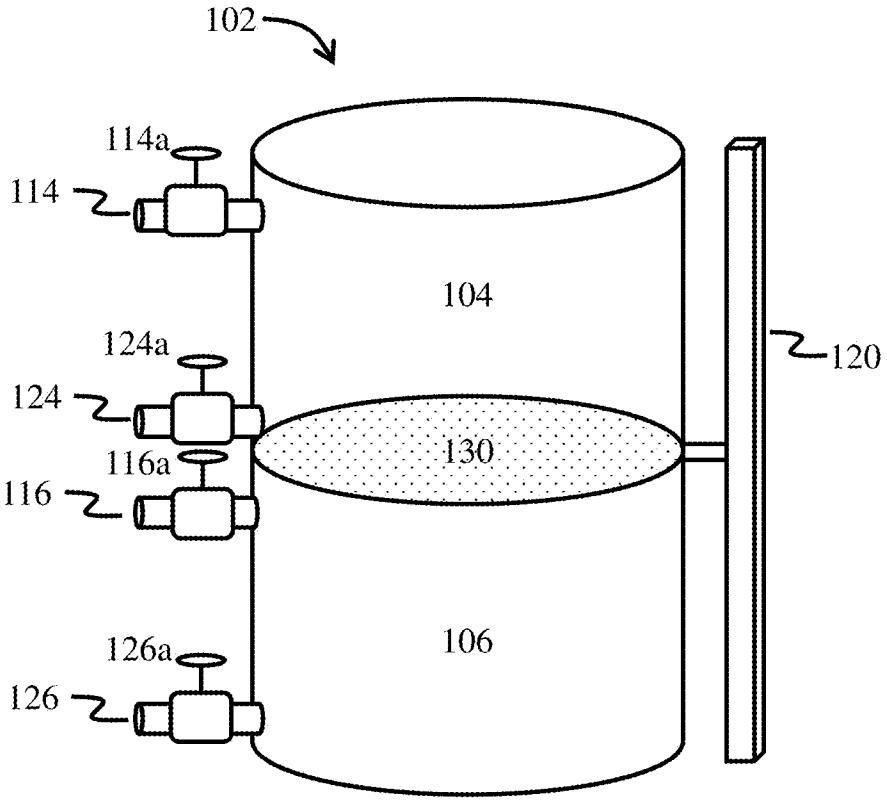
FIG. 1 is a block diagram depicting components of a pressure regulated volume exchange container, according to an embodiment.

The following detailed description refers to the accompanying drawings. Wherever possible, the same reference numbers are used in the drawings and the following description to refer to the same or similar elements. While embodiments of the claimed subject matter may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed embodiments offer an improvement over prior art systems by integrating a controlled pressure mechanism and a movable barrier within a single container to facilitate the efficient exchange of unused and used fluids. By employing a linear actuator, spring, or similar device, the container maintains a stable internal pressure that drives the movement of the barrier as fluid is extracted or introduced. This controlled pressure system allows for precise management of fluid volumes within the container, ensuring that the unused fluid is dispensed smoothly from the upper portion while simultaneously accommodating the influx of the used fluid from the bottom. The coordinated action of the barrier not only prevents spillage and cross-contamination but also optimizes the use of available space, as the barrier adjusts dynamically to the changing fluid volumes.

The claimed embodiments also improve over prior art systems by offering a compact, space-saving solution through the integration of both fluid storage and separation functions within a single container. Unlike traditional setups that require multiple containers or external reservoirs for storing unused and used fluids separately, this claimed embodiments consolidate these processes, eliminating the need for additional space-consuming components. By housing both fluids within a single structure and employing a movable barrier to dynamically adjust fluid volumes, the embodiments significantly reduce the spatial footprint required for fluid exchange operations. This compact design not only simplifies installation and storage but also enhances portability, making it ideal for applications in constrained environments where space is at a premium. The efficiency gained through the single-container approach allows users to achieve the same fluid separation and storage results without the complexity and bulk of traditional multi-component systems, thereby maximizing operational space and enabling a more practical and versatile fluid management solution.

Unlike prior art systems that rely on passive gravity-based movement, the claimed embodiments create a more active and reliable fluid exchange, minimizing the need for external handling or additional equipment. The single-container design reduces spatial requirements while providing a compact and efficient solution for applications where both access to clean fluid and collection of runoff are essential. The claimed embodiments are advantageous for tasks requiring repetitive or continuous fluid exchanges, as the pressure-regulated barrier adapts automatically, reducing the need for manual oversight. Furthermore, by isolating unused and used fluids within the container, the invention enhances fluid purity and quality, allowing the unused fluid to remain uncontaminated throughout the operation. Overall, the claimed embodiments address the limitations of prior art systems by offering a streamlined, efficient, and self-contained solution for fluid management and conservation. One of the possible applications of the claimed embodiments is zero impact camping, wherein campers attempt to have little to no impact on the surrounding area, which requires that the campers bring all of the fluid they intend to use, and pack out all of the expended fluid they intend to dispel.

The accompanying drawings, which are incorporated in and constitute a part of this disclosure, illustrate various example embodiments. The claimed pressure regulated volume exchange container 100 will now be described with respect to FIGS. 1 through 4.

FIG. 1 is a block diagram depicting components of a pressure regulated volume exchange container 100, according to an embodiment. In FIG. 1, the container 102 serves as the main structure for holding both the unused and used fluids within distinct regions or volumes, designated as the first volume 104 and the second volume 106, respectively. The first volume 104 is intended to store the unused fluid that will be dispensed or utilized. The second volume 106 receives and stores the used fluid after it has been drawn from the first volume, effectively isolating it within the container to prevent contamination of the unused fluid. Though FIG. 1 shows one volume on top of the other, this is for exemplary purposes only and the claimed embodiments support any arrangement of the two volumes.

A movable barrier 130 is positioned within the container 102, separating the first volume 104 from the second volume 106. This barrier 130 is designed to adjust its position as the fluid volumes change, thereby maintaining a consistent division between the two fluids while allowing the container to accommodate varying amounts of each fluid. The movable barrier may be a flexible diaphragm configured to form a seal between the first volume portion and the second volume portion, preventing cross-contamination between the first and second fluids.

The movement of this barrier is controlled by an actuator 120, which applies pressure or force to move the barrier in response to the extraction of the unused fluid or the introduction of the used fluid, as well as in response to other factors. The actuator may be a linear actuator, spring, or any mechanical device that is configured to move the barrier in the upwards and/or downwards directions. This actuator 120 is essential for ensuring that the first and second volumes remain isolated, and that the barrier can adjust dynamically based on fluid demands, as well as maintaining certain pressure requirements, among other things.

Fluid entry and exit from the container are managed through several inlets and outlets equipped with valves. The first volume inlet 114 in the container allows for the introduction of the unused fluid into the first volume 104. The first volume inlet valve 114*a* regulates this inlet, opening or closing as needed to control the inflow of unused fluid. The first volume outlet 124 in the container provides an exit for the unused fluid when it is needed externally. The first volume outlet valve 124*a* controls this outlet, ensuring that fluid flow occurs only when required.

The second volume inlet 116 in the container serves as the entry point for the used fluid into the second volume 106. The second volume inlet valve 116*a* regulates this inlet, enabling controlled entry of the used fluid and ensuring it remains separated from the unused fluid in the first volume. The second volume outlet 126 in the container allows for the discharge of the used fluid when necessary. The second volume outlet valve 126*a* manages this outlet, providing controlled exit for the used fluid and allowing for easy removal or disposal.

In combination, the described components enable efficient management of both unused and used fluids within a single container, providing controlled separation and access through a dynamic, actuated barrier system. Each inlet and outlet, together with its respective valve, functions in concert with the movable barrier 130 and actuator 120 to ensure that the fluid volumes are handled precisely, enabling a compact and efficient solution for fluid exchange and storage.

Figure 2A:
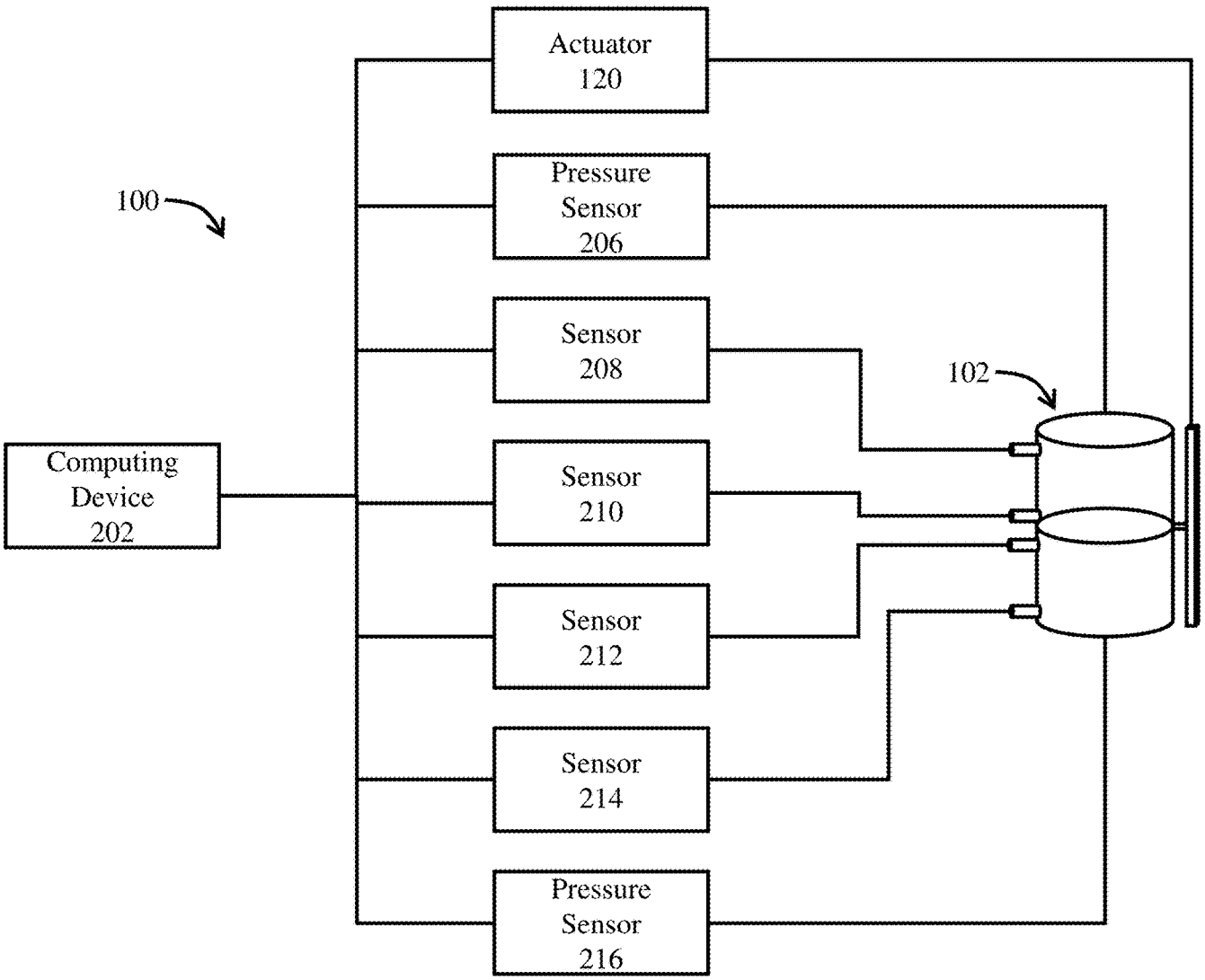
FIG. 2A is a block diagram depicting components for data transfer of the pressure regulated volume exchange container, according to an embodiment.

It should be noted that even though FIG. 1 discloses only one container, two volumes, one barrier, one actuator, two inlets, two outlet, and four valves, the different embodiments of the invention support any number of volumes, barriers, actuator, inlets, outlets and valves. For example, in one embodiment of the invention, two or more actuators can be used to apply pressure or force to move the barrier in response to the extraction of the unused fluid or the introduction of the used fluid, as well as in response to other factors FIG. 2A is a block diagram depicting components for data transfer of the pressure regulated volume exchange container 100, according to an embodiment. In FIG. 2A, the computing device 202 is shown as the central control unit, interfacing with various sensors and the actuator 120 to monitor and regulate fluid flow and pressure within the pressure regulated volume exchange container 100. The computing device 202 is connected to the actuator 120, enabling it to control the movement of the barrier (described in FIG. 1) within the container 102. By commanding the actuator 120, the computing device can adjust the barrier's position in response to changing fluid levels and pressure, ensuring that the unused and used fluids remain isolated while maintaining consistent separation within the container.

The actuator 120 is configured to provide servo data to the computing device 202, delivering real-time feedback on its position, speed, and force exerted in moving the barrier within the container. This servo data allows the computing device to track the precise position of the barrier, ensuring proper pressure within the volumes and inlets/outlets, as well as accurate separation between the first and second volumes as fluids are introduced or extracted. By monitoring the actuator's position, speed and force output, the computing device can detect any resistance or irregularities in the movement of the barrier, which may indicate issues such as fluid imbalances or mechanical obstructions. This feedback loop enables the computing device to make real-time adjustments, optimizing actuator performance to maintain ideal fluid levels and pressures within the container and the inlets/outlets.

A first volume pressure sensor 206 is positioned within the first volume 104 to detect and measure the pressure of the unused fluid. This sensor provides real-time data on the pressure within the first volume, enabling the computing device 202 to monitor the conditions of the unused fluid. If the pressure deviates from expected levels-indicating, for example, a change in fluid volume or a potential leak—the computing device 202 can adjust the actuator 120 to maintain optimal or desired conditions. Similarly, a second volume pressure sensor 216 is located within the second volume 106 to measure the pressure of the used fluid. The data from this sensor informs the computing device 202 about the conditions in the second volume, allowing it to detect any fluctuations that may necessitate adjustments to the actuator or the outlet valves.

Additionally, FIG. 2A illustrates a series of pressure or flow sensors connected to various inlets and outlets, providing the computing device with comprehensive information on fluid movement throughout the system. A pressure or flow sensor 208 is associated with the first volume inlet 114, monitoring the inflow of unused fluid into the container. This sensor measures both the rate of flow and the pressure, allowing the computing device 202 to regulate the inflow in accordance with the needs of the system. Similarly, a pressure or flow sensor 210 is connected to the first volume outlet 124, measuring the outflow of unused fluid from the first volume. By monitoring this data, the computing device can manage the flow rate and ensure that fluid is dispensed efficiently and according to demand.

The second volume inlet 116 is equipped with a pressure or flow sensor 212, which reads the inflow characteristics of the used fluid as it enters the container. This sensor provides the computing device with critical information on the used fluid entering the system, allowing the computing device to maintain the balance between unused and used fluid volumes. Lastly, a pressure or flow sensor 214 is connected to the second volume outlet 126, measuring the outflow of used fluid from the second volume. Data from this sensor allows the computing device to control the discharge of used fluid and maintain system equilibrium, preventing overflow or unintended discharge.

Using the collective data from these sensors, the computing device 202 can execute precise control over the actuator 120 and the flow of fluids within the container. By continuously analyzing pressure and flow data, the computing device dynamically manages fluid exchange, barrier positioning, and valve operation to optimize the system's efficiency and reliability. This real-time, sensor-driven approach enables the container to adapt to varying fluid levels and pressures, ensuring that unused and used fluids are consistently separated and handled within the single-container system.

Figure 2B:
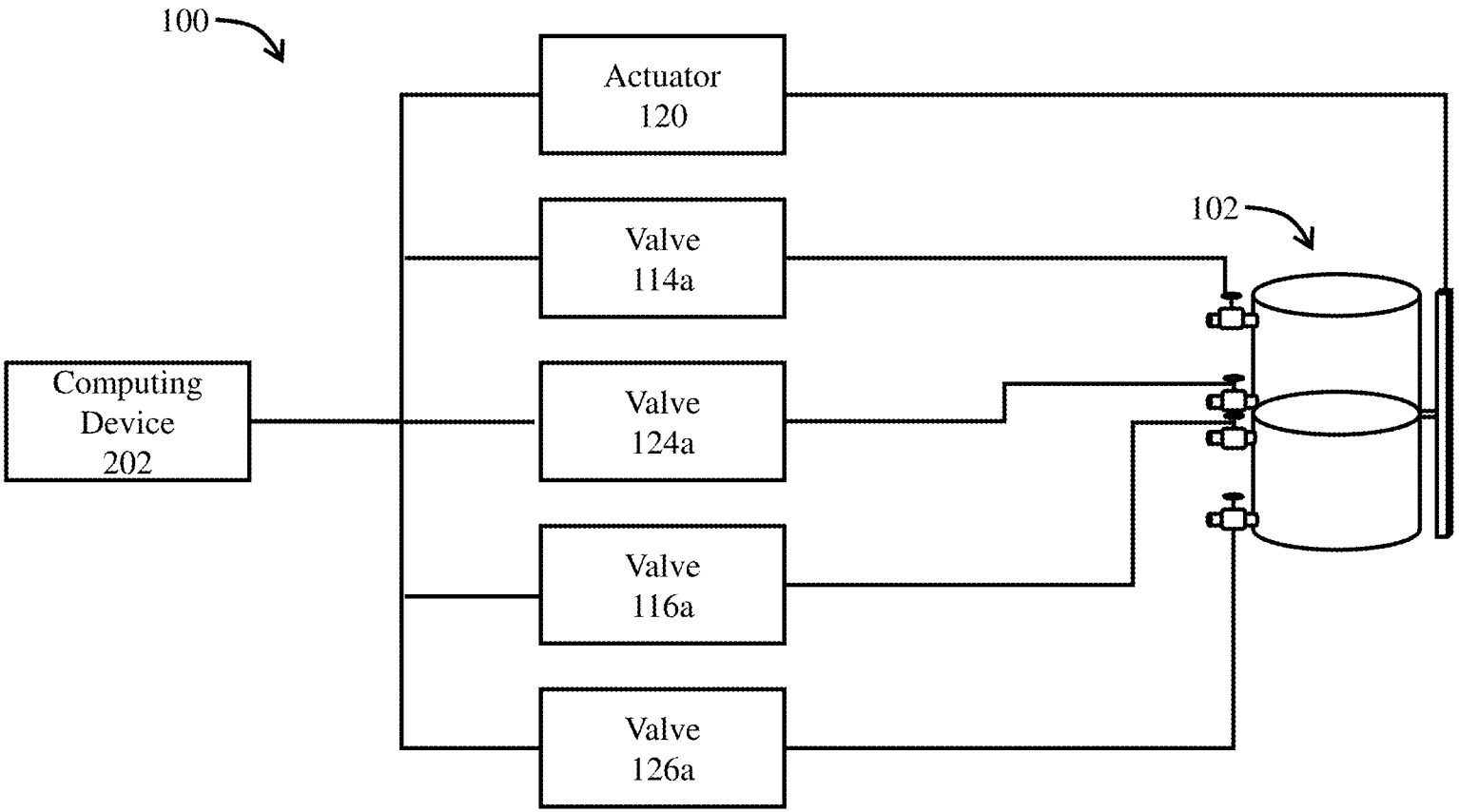
FIG. 2B is a block diagram depicting components for controlling the pressure regulated volume exchange container, according to an embodiment.

FIG. 2B is a block diagram depicting components for controlling the pressure regulated volume exchange container 100, according to an embodiment. In FIG. 2B, the computing device 202 is depicted as a centralized control system that interfaces with the actuator 120 and the valves 114*a*, 124*a*, 116*a*, and 126*a*, coordinating the movement of fluids within the container in response to real-time data inputs. The computing device 202 controls the actuator 120, adjusting its position to move the barrier within the container as fluid levels change. Using the data collected from the pressure and flow sensors, the computing device can direct the actuator 120 to maintain the appropriate separation between the unused and used fluids, ensuring that the fluid volumes are dynamically balanced.

Valve 114*a* is connected to the first volume inlet 114 and is responsible for controlling the flow of unused fluid into the container. The computing device 202 utilizes data on the current volume and pressure of the unused fluid to open or close valve 114*a* as needed, regulating the introduction of unused fluid based on system requirements. Valve 124*a*, associated with the first volume outlet 124, controls the outflow of unused fluid from the container. By monitoring pressure and flow data at the outlet, the computing device can operate valve 124*a* to manage the dispensing of unused fluid, ensuring that it flows only when necessary and at an optimal rate.

Valve 116*a* is connected to the second volume inlet 116, which controls the entry of used fluid into the container. Based on data from the second volume pressure sensor and other system inputs, the computing device 202 operates valve 116*a* to allow used fluid to flow into the container at a controlled rate, adjusting as needed to maintain the separation of fluids and avoid overflow. Finally, valve 126*a*, connected to the second volume outlet 126, regulates the discharge of used fluid from the container. The computing device uses flow and pressure data to open or close valve 126*a* as necessary, allowing for the efficient removal of used fluid when required while maintaining pressure equilibrium within the system.

By coordinating the operation of the actuator 120 and valves 114*a*, 124*a*, 116*a*, and 126*a*, the computing device 202 dynamically manages pressure, fluid exchange and separation within the container, adapting to changing conditions in real time to optimize system performance. The ability to precisely control each component ensures efficient fluid transfer, effective separation of unused and used fluids, and maintenance of stable pressures and fluid levels within the container.

Figure 3:
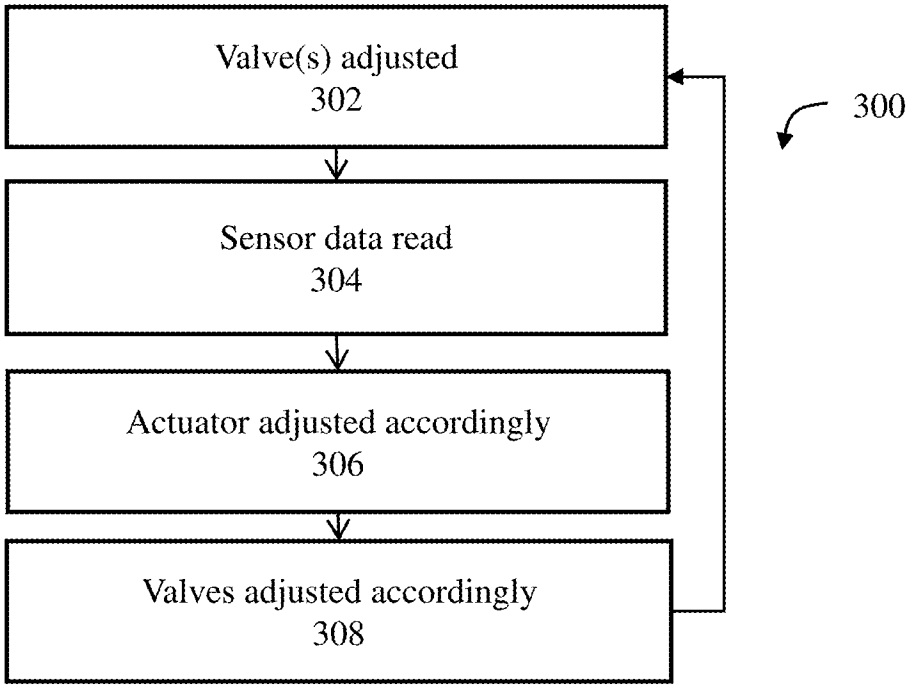
FIG. 3 is a flow chart depicting the general control flow of a process undertaken by the pressure regulated volume exchange container, according to an embodiment.

FIG. 3 is a flow chart depicting the general control flow of a process 300 undertaken by the pressure regulated volume exchange container 100, according to an embodiment. Process 300 begins with the initial step 302, wherein a position of a valve, such as valve 114*a*, is adjusted, which may be opened, closed, or set to a specific intermediate position. This valve adjustment controls the inflow or outflow of fluid, depending on the operational state of the container.

Once the valve has been adjusted, in step 304 the computing device 202 proceeds to the data-reading phase, where it collects real-time information from the multiple sensors embedded within the system (see FIG. 2A). This includes pressure data from pressure sensors positioned in the first and second volumes, flow rates from flow sensors connected to the inlets and outlets, and servo data from the actuator. The computing device 202 processes this information to gain an accurate snapshot of current fluid levels, flow rates, and pressures within the container. This comprehensive data set provides insight into the fluid conditions in both the unused and used volumes, as well as the operational state of each component.

Following data collection, the computing device 202 analyzes the sensor readings to determine if any adjustments are needed to maintain the predefined pressure within the first volume and stable fluid separation within the container. For example, if the pressure in the first volume deviates from the predefined threshold, the computing device will calculate the necessary adjustments to the actuator's position to bring the pressure back within the desired range. This analysis may also include assessing the actuator's force and speed, as derived from the servo data, to ensure that the actuator's movement aligns with the requirements for pressure regulation and volume balance.

Based on this analysis, in step 306, the computing device 202 executes an adjustment to the actuator in the next step. The computing device sends a command to the actuator to move the barrier within the container in a precise manner. This movement is calibrated to account for the fluid volume change in the first and second volumes, with the goal of preserving the designated separation between unused and used fluids. The actuator adjustment is executed smoothly to prevent any abrupt shifts in pressure or fluid levels that could compromise the system's performance or fluid quality.

In the final step 308, the computing device 202 makes any necessary adjustments to the valves connected to the fluid inlets and outlets. Using the previously analyzed sensor data, the computing device determines whether to further open, close, or modulate each valve to control fluid flow effectively. By adjusting the valves, the computing device ensures that fluid can enter or exit the container as needed without disrupting the internal pressure or the separation between the first and second volumes. Once these adjustments are complete, the computing device re-initiates the process, returning to step 302, continuously reading data and making real-time adjustments to maintain optimal system performance and fluid separation.

Figure 4:
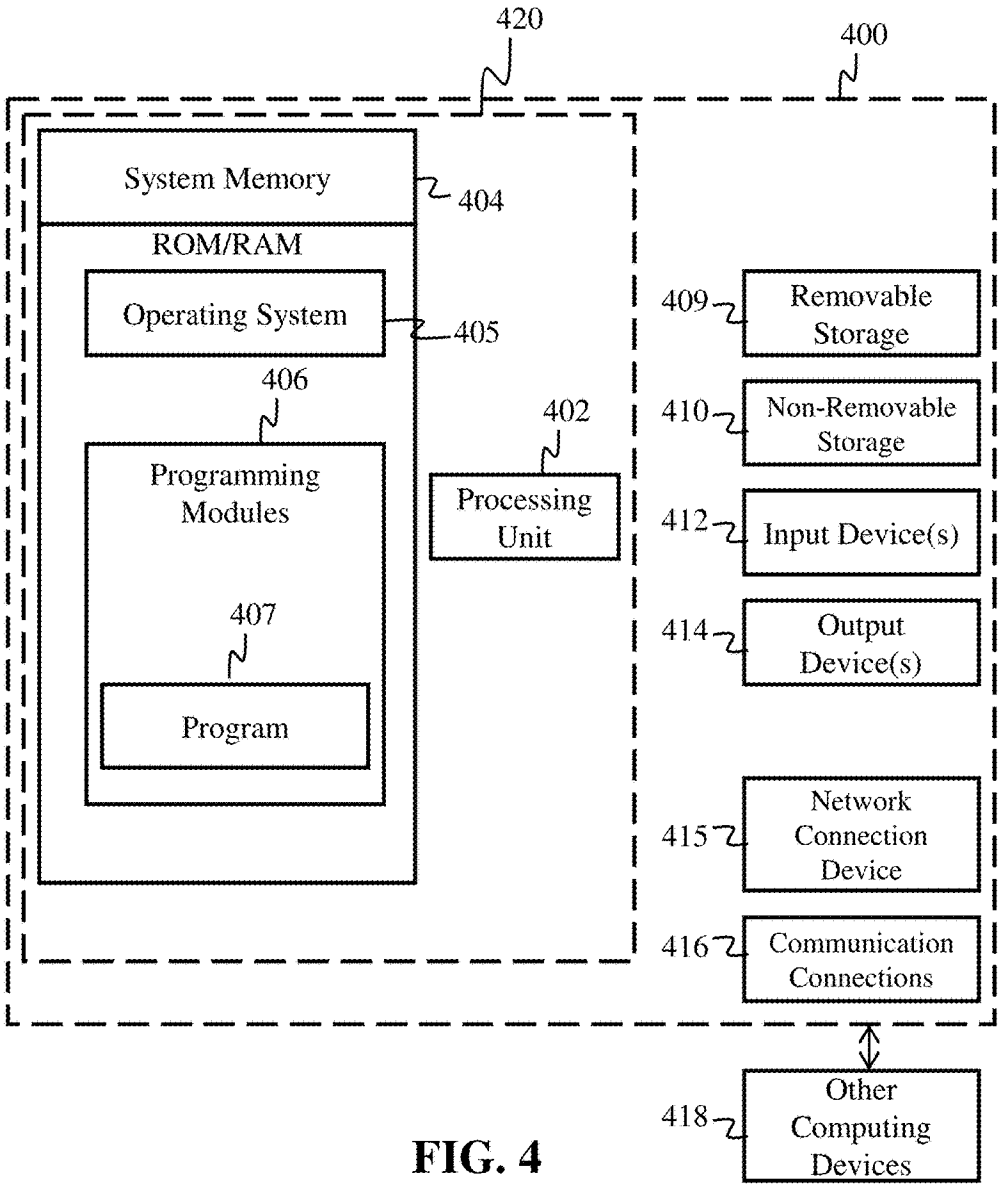
FIG. 4 is a block diagram depicting a system including an example computing device and other computing devices.

FIG. 4 is a block diagram of a system including an example computing device 400 and other computing devices. Consistent with the embodiments described herein, the aforementioned actions performed by 202, 120 may be implemented in a computing device, such as the computing device 400 of FIG. 4. Any suitable combination of hardware, software, or firmware may be used to implement the computing device 400. The aforementioned system, device, and processors are examples and other systems, devices, and processors may comprise the aforementioned computing device. Furthermore, computing device 400 may comprise an operating environment for system 100 and process 300, as described above. Process 300 may operate in other environments and are not limited to computing device 400.

With reference to FIG. 4, a system consistent with an embodiment may include a plurality of computing devices, such as computing device 400. In a basic configuration, computing device 400 may include at least one processing unit 402 and a system memory 404. Depending on the configuration and type of computing device, system memory 404 may comprise, but is not limited to, volatile (e.g., random-access memory (RAM)), non-volatile (e.g., read-only memory (ROM)), flash memory, or any combination or memory. System memory 404 may include operating system 405, and one or more programming modules 406. Operating system 405, for example, may be suitable for controlling computing device 400's operation. In one embodiment, programming modules 406 may include, for example, a program module 407 for executing the actions of 202, 120. Furthermore, embodiments may be practiced in conjunction with a graphics library, other operating systems, or any other application program and is not limited to any particular application or system. This basic configuration is illustrated in FIG. 4 by those components within a dashed line 420.

Computing device 400 may have additional features or functionality. For example, computing device 400 may also include additional data storage devices (removable and/or non-removable) such as, for example, magnetic disks, optical disks, or tape. Such additional storage is illustrated in FIG. 4 by a removable storage 409 and a non-removable storage 410. Computer storage media may include volatile and nonvolatile, removable and non-removable media implemented in any method or technology for storage of information, such as computer readable instructions, data structures, program modules, or other data. System memory 404, removable storage 409, and non-removable storage 410 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 400. Any such computer storage media may be part of device 400. Computing device 400 may also have input device(s) 412 such as a keyboard, a mouse, a pen, a sound input device, a camera, a touch input device, etc. Output device(s) 414 such as a display, speakers, a printer, etc. may also be included. Computing device 400 may also include a vibration device capable of initiating a vibration in the device on command, such as a mechanical vibrator or a vibrating alert motor. The aforementioned devices are only examples, and other devices may be added or substituted.

Computing device 400 may also contain a network connection device 415 that may allow device 400 to communicate with other computing devices 418, such as over a network in a distributed computing environment, for example, an intranet or the Internet. Device 415 may be a wired or wireless network interface controller, a network interface card, a network interface device, a network adapter or a LAN adapter. Device 415 allows for a communication connection 416 for communicating with other computing devices 418. Communication connection 416 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both computer storage media and communication media.

As stated above, a number of program modules and data files may be stored in system memory 404, including operating system 405. While executing on processing unit 402, programming modules 406 (e.g. program module 407) may perform processes including, for example, one or more of the stages of process 300 as described above. The aforementioned processes are examples, and processing unit 402 may perform other processes. Other programming modules that may be used in accordance with embodiments herein may include electronic mail and contacts applications, word processing applications, spreadsheet applications, database applications, slide presentation applications, drawing or computer-aided application programs, etc.

Generally, consistent with embodiments herein, program modules may include routines, programs, components, data structures, and other types of structures that may perform particular tasks or that may implement particular abstract data types. Moreover, embodiments herein may be practiced with other computer system configurations, including hand-held devices, multiprocessor systems, microprocessor-based or programmable consumer electronics, minicomputers, mainframe computers, and the like. Embodiments herein may also be practiced in distributed computing environments where tasks are performed by remote processing devices that are linked through a communications network. In a distributed computing environment, program modules may be located in both local and remote memory storage devices.

Furthermore, embodiments herein may be practiced in an electrical circuit comprising discrete electronic elements, packaged or integrated electronic chips containing logic gates, a circuit utilizing a microprocessor, or on a single chip (such as a System on Chip) containing electronic elements or microprocessors. Embodiments herein may also be practiced using other technologies capable of performing logical operations such as, for example, AND, OR, and NOT, including but not limited to mechanical, optical, fluidic, and quantum technologies. In addition, embodiments herein may be practiced within a general purpose computer or in any other circuits or systems.

Embodiments herein, for example, are described above with reference to block diagrams and/or operational illustrations of methods, systems, and computer program products according to said embodiments. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments have been described, other embodiments may exist. Furthermore, although embodiments herein have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages and/or inserting or deleting stages, without departing from the claimed subject matter.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A pressure-regulated volume exchange container, comprising:

a) a container body configured to hold both a first fluid and a second fluid, the container body defining a first volume portion and a second volume portion;

b) a movable barrier disposed within the container body, the barrier configured to adjust a size of the first and second volume portions;

c) an outlet in the container body through which the first fluid is extracted from the first volume portion;

d) an inlet in the container body through which the second fluid is introduced into the second volume portion; and e) an actuator mechanism operably connected to the movable barrier, configured to move the barrier within the container body in response to extraction of fluid from, or introduction of fluid to, the container body, wherein said actuator mechanism moves said movable barrier so as to maintain a predefined pressure within the first volume portion.

2. The pressure-regulated volume exchange container of claim 1, wherein the actuator mechanism comprises a linear actuator configured to move the movable barrier in response to changes in fluid volume within the first volume portion and second volume portion.

3. The pressure-regulated volume exchange container of claim 1, further comprising a first pressure sensor positioned within the first volume portion to monitor the pressure of the first fluid, the pressure sensor communicatively coupled to a computing device that controls the actuator mechanism based on the monitored pressure.

4. The pressure-regulated volume exchange container of claim 3, wherein the computing device is configured to receive real-time pressure data from the first pressure sensor and adjust the actuator mechanism to maintain a predefined pressure within the first volume portion.

5. The pressure-regulated volume exchange container of claim 1, further comprising a second pressure sensor positioned within the second volume portion to monitor the pressure of the second fluid, wherein the computing device adjusts the actuator mechanism based on data from both the first and second pressure sensors.

6. The pressure-regulated volume exchange container of claim 1, wherein the container body further comprises a first volume inlet valve positioned at the inlet of the first volume portion and a first volume outlet valve positioned at the outlet of the first volume portion, each valve configured to regulate fluid flow in response to commands from the computing device.

7. The pressure-regulated volume exchange container of claim 6, wherein the computing device is further configured to control the first volume inlet valve and first volume outlet valve based on fluid demand, pressure, and volume levels within the first volume portion.

8. The pressure-regulated volume exchange container of claim 1, wherein the movable barrier comprises a flexible diaphragm configured to form a seal between the first volume portion and the second volume portion, preventing cross-contamination between the first and second fluids.

9. The pressure-regulated volume exchange container of claim 1, wherein the actuator mechanism is configured to provide servo data to the computing device, the servo data including information on the position, speed, and force exerted by the actuator on the movable barrier.

10. The pressure-regulated volume exchange container of claim 1, further comprising a flow sensor positioned at the inlet of the first volume portion, wherein the flow sensor provides data to the computing device to regulate the rate of fluid intake into the first volume portion.

11. A pressure-regulated volume exchange container, comprising:

a) a container body configured to hold both a first fluid and a second fluid, the container body defining a first volume portion and a second volume portion;

b) a movable barrier disposed within the container body, the barrier configured to adjust a size of the first and second volume portions;

c) an outlet in the container body through which the first fluid is extracted from the first volume portion;

d) an inlet in the container body through which the second fluid is introduced into the second volume portion;

e) a first pressure sensor in the first volume portion;

f) an actuator mechanism operably connected to the movable barrier, configured to move the barrier within the container body when activated; and g) a computing device communicatively coupled to the first pressure sensor and the actuator mechanism, the computing device configured to: 1) read pressure data from the first pressure sensor, 2) calculate a desired position of the movable barrier within the container body so as to achieve a first predefined pressure within the first volume portion, and 3) activate the actuator mechanism to move the movable barrier to the desired position.

12. The pressure-regulated volume exchange container of claim 11, wherein the actuator mechanism comprises a linear actuator configured to move the movable barrier in response to changes in fluid volume within the first volume portion and second volume portion.

13. The pressure-regulated volume exchange container of claim 11, further comprising a second pressure sensor positioned within the second volume portion to monitor the pressure of the second fluid, wherein the computing device adjusts the actuator mechanism based on data from both the first and second pressure sensors.

14. The pressure-regulated volume exchange container of claim 11, wherein the container body further comprises a first volume inlet valve positioned at the inlet of the first volume portion and a first volume outlet valve positioned at the outlet of the first volume portion, each valve configured to regulate fluid flow in response to commands from the computing device.

15. The pressure-regulated volume exchange container of claim 14, wherein the computing device is further configured to control the first volume inlet valve and first volume outlet valve based on fluid demand, pressure, and volume levels within the first volume portion.

16. The pressure-regulated volume exchange container of claim 11, wherein the movable barrier comprises a flexible diaphragm configured to form a seal between the first volume portion and the second volume portion, preventing cross-contamination between the first and second fluids.

17. The pressure-regulated volume exchange container of claim 11, wherein the actuator mechanism is configured to provide servo data to the computing device, the servo data including information on the position, speed, and force exerted by the actuator on the movable barrier.

18. The pressure-regulated volume exchange container of claim 11, further comprising a flow sensor positioned at the inlet of the first volume portion, wherein the flow sensor provides data to the computing device to regulate the rate of fluid intake into the first volume portion.

* * * * *